US006532807B1

(12) United States Patent
Krauss

(10) Patent No.: US 6,532,807 B1
(45) Date of Patent: Mar. 18, 2003

(54) COOLING SYSTEM FOR AN INTERNAL COMBUSTION ENGINE IN MOTOR VEHICLES AND OPERATING PROCESS THEREFOR

(75) Inventor: Michael Krauss, Munich (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 09/662,319

(22) Filed: Sep. 14, 2000

(30) Foreign Application Priority Data

Oct. 7, 1999 (DE) ..... 199 48 249

(51) Int. Cl.[7] ..... G01M 15/00
(52) U.S. Cl. ..... 73/118.1
(58) Field of Search ..... 73/116, 117.2, 73/117.3, 118.1, 119 R; 340/438, 439, 449

(56) References Cited

U.S. PATENT DOCUMENTS

| | | | |
|---|---|---|---|
| 5,215,044 A | 6/1993 | Banzhaf et al. | 123/41.29 |
| 5,526,871 A | 6/1996 | Musser et al. | 165/11.1 |

FOREIGN PATENT DOCUMENTS

| | | |
|---|---|---|
| DE | 37 05 232 A1 | 9/1988 |
| DE | 43 24 178 A1 | 1/1995 |
| EP | 0 557 113 | 8/1993 |
| EP | 0 761 940 | 3/1997 |
| FR | 2 673 244 | 8/1992 |
| FR | 2 773 845 | 7/1999 |
| GB | 2 348 297 | 9/2000 |

*Primary Examiner*—Eric S. McCall
(74) *Attorney, Agent, or Firm*—Crowell & Moring LLP

(57) ABSTRACT

A cooling system for an internal combustion engine has a pipeline leading from the internal combustion engine to a radiator, a return pipeline from the radiator to the internal combustion engine, a bypass line connecting the pipeline and the return pipeline, and a thermostat valve, through which the coolant is passed from the internal combustion engine through the bypass line and/or through the radiator back to the internal combustion engine, depending on the operating conditions. At least one temperature sensor is provided in the cooling system, and an output signal is supplied to a control unit. In the case of a change from a first operating condition, for which the coolant must be passed through the thermostat valve initially only through the bypass line, to a second operating condition, for which the coolant is permitted to flow through the thermostat at least partially through the radiator, the control unit checks whether an increase in the temperature of the coolant commences at the outlet of the radiator.

10 Claims, 1 Drawing Sheet

COOLING SYSTEM FOR AN INTERNAL COMBUSTION ENGINE IN MOTOR VEHICLES AND OPERATING PROCESS THEREFOR

This application claims the priority of German application 199 48 249.7, filed Oct. 7, 1999, the disclosure of which is expressly incorporated by reference herein.

BACKGROUND AND SUMMARY OF THE INVENTION

The present invention relates to a particular cooling system for an internal combustion engine in a motor vehicle. The cooling system includes a pipeline leading from the internal combustion engine to a radiator, a return pipeline leading from the radiator to the internal combustion engine, a bypass line connecting the pipeline and the return pipeline, and a thermostat valve, through which the coolant is passed. The invention also relates to an operating process for such a system.

This type of cooling system is known, for example, from German publication DE 37 05 232 A1. In such a system, the thermostat valve may contain, for example, an expansion element, which may or may not be heated. Reference is also made to German publication DE 43 24 178 A1 in connection with the feature of having different operating conditions lead to opening, partial opening and closing of the thermostat valve.

It is also known that, for checking whether the thermostat valve is in working order, a first temperature sensor for determining the inlet temperature of the thermostat and a second temperature sensor for determining the outlet temperature of the thermostat may be provided internally. In this construction, the inlet temperature of the thermostat corresponds to the temperature of the coolant at the outlet of the internal combustion engine, that is to the temperature of the coolant, which is to be cooled, and the outlet temperature of the thermostat corresponds to the coolant temperature at the outlet of the radiator, that is to the temperature of the cooled coolant, when the coolant has been passed at least partially through the radiator. During a checking routine, a defect in the thermostat valve is noted, firstly, if the inlet temperature of the thermostat is below the temperature at which the thermostat opens and the thermostat valve permits the coolant to flow back to the internal combustion engine only over the bypass, and, secondly, if there is a temperature difference between the outlet and inlet temperatures of the thermostat which is smaller than a specified error identification threshold. When the thermostat valve is in working order and the coolant temperature is below the thermostat opening temperature, the thermostat outlet temperature, as defined above, must be much lower than the thermostat inlet temperature. However, by this checking routine, only jamming of the thermostat valve can be recognized. Additional monitoring of the control temperature is not possible.

It is an object of the invention to provide a reliable diagnosis of the whole functioning capability of the thermostat valve in a cooling system of the type described above.

This objective is accomplished by providing at least one temperature sensor to determine the temperature of coolant at an outlet of the radiator, and supplying an output signal of the at least one temperature sensor to a control unit. When a first operating condition, for which the coolant must be passed by way of the thermostat valve initially only through the bypass line, changes to a second operating condition, for which the coolant is permitted to flow by way of the thermostat at least partially through the radiator, the control unit checks on whether an increase in the temperature of the coolant commences at the outlet of the radiator. Advantageous further developments of the invention are also reflected in the claims.

Thus, according to the invention, at least one temperature sensor is provided for determining the temperature of the coolant at the outlet of the radiator. The output signal of the temperature sensor is supplied to a preferably electronic control unit, which is already present anyhow in known cooling systems. Moreover, the output signal of the temperature sensor can be transferred either directly or, for example, over a bus connection from a different control device. The control unit, which usually also receives and processes other input signals, checks when there is a changeover from a first operating condition, during which the coolant would have to be passed through the thermostat valve initially only through the bypass line, to a second operating condition, for which the coolant would have to be released by the thermostat valve to flow at least partially through the radiator, and whether an increase in the temperature of the coolant is beginning at the outlet of the radiator.

Preferably, a second temperature sensor is provided in order to determine the temperature of the coolant at the outlet of the internal combustion engine. This second temperature sensor may be mounted, for example, in a cylinder head of the internal combustion engine. The output signal of this sensor is also supplied to a control unit. The most important operating conditions for opening, partially opening and closing the thermostat are related to the temperature of the coolant.

The second operating condition, which leads to the at least partial opening of the thermostat valve or to the partial release of coolant flow over the radiator, preferably is the attainment of a specified coolant temperature at the outlet of the internal combustion engine. This specified coolant temperature preferably is the so-called opening temperature. Further operating conditions may also relate, for example, to the ambient temperature or to the rotational speed of the internal combustion engine. The invention can be used for unheated thermostat valves as well as for thermostat valves, which can be heated.

The invention is based on the realization that, when the thermostat is functioning properly, the cooling water, before the opening temperature (the control temperature) is reached, flows exclusively in a so-called small cycle, that is, only through the bypass, avoiding the radiator. At the same time, the coolant temperature at the outlet of the radiator remains at an approximately constant level. When the operating condition, such as the opening temperature, is reached for opening the thermostat, the coolant flows for the first time, at least partially, through the radiator. As a result, the temperature of the coolant at the outlet of the radiator rises. If an increase in the temperature of the coolant at the outlet of the radiator is not recognized, although the thermostat would have had to be open in accordance with the specified operating conditions, then a fault indication may be put out in accordance with the known on-board diagnosis specifications. The fault indication may, for example, indicate a jamming of the thermostat valve in the closed state. In this case, the thermostat valve can be repaired.

The control unit preferably also checks whether the coolant temperature at the outlet of the internal combustion engine is above a second threshold, after the temperature of the coolant at the outlet of the radiator has reached or exceeded a first threshold. The first threshold is below the second threshold. An increase in the temperature of the coolant at the outlet of the radiator, for example by a specified amount, can be used as a reliable release condition for running the diagnosis required in the control operation. The second threshold advantageously is selected to correspond to specified environmental regulations, so that it corresponds to a coolant temperature or an internal combustion engine temperature, which is necessary at least for optimizing the emission values and/or for releasing further diagnosis functions relevant to the exhaust gas. If the coolant temperature at the outlet of the internal combustion engine in the control operation, that is, when the temperature of the coolant has already risen, is below this second threshold, then a fault indication is also put out. In this case, in a fault memory, a possibly wrong design of the thermostat valve or a leakage in the thermostat valve can be indicated. The thermostat valve accordingly must be replaced.

The invention makes it possible to perform an overall diagnosis with differentiated fault indications.

An embodiment of the invention is shown in the drawings.

DESCRIPTION OF THE PREFERRED EMBODIMENT

Figure 1:
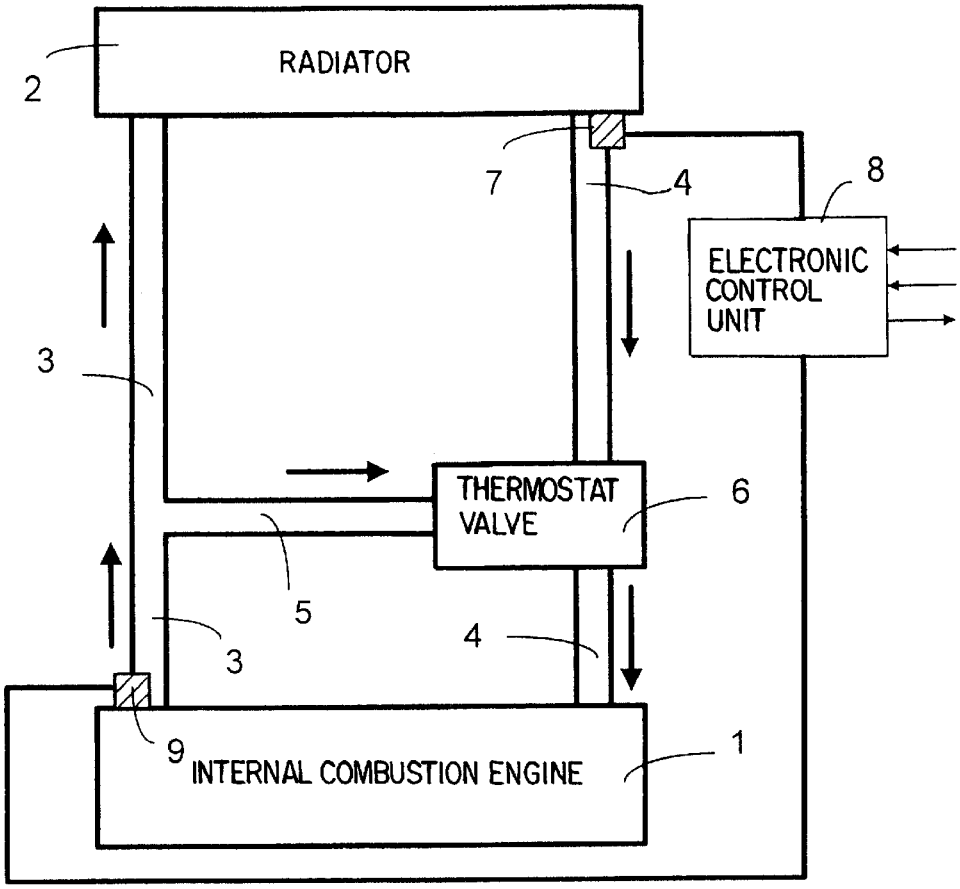
FIG. 1 shows a diagrammatic representation of the individual components of the inventive cooling system.

In FIG. 1, a cooling system of a motor vehicle (not shown) with an internal combustion engine 1 is shown as having a radiator 2, a pipeline 3 leading from the internal combustion engine 1 to the radiator 2, a return line 4 leading from the radiator 2 to the internal combustion engine 1, a bypass 5 connecting the pipeline 3 and the return line 4, and a thermostat valve 6, which is disposed in the bypass line 5. The thermostat valve 6 is disposed and designed so that, as a function of the operating conditions, especially of the temperature of the coolant at the inlet of the thermostat, coolant is passed from the internal combustion engine 1 through the bypass 5 and/or through the radiator 2 back to the internal combustion engine 1. Such cooling systems are known. DE 43 24 178 A1 is referred to for further details.

By way of such a cooling system, when the internal combustion engine 1 is cold and, therefore, the coolant temperature is low, the coolant bypasses the radiator 2 over the bypass line 5 and is returned without being cooled to the internal combustion engine 1. In this way, the internal combustion engine is heated rapidly, as a result of which emissions from the internal combustion engine are decreased.

Control to a specified coolant temperature takes place over an appropriate design and/or heat triggering of the thermostat valve 6. Reliable monitoring is required for this function since it is relevant to the exhaust gas.

For this purpose, a first temperature sensor 7 is mounted at the outlet of the radiator and a second temperature sensor 9 is mounted at the outlet of the internal combustion engine 1 or, preferably, in a cylinder head of the internal combustion engine 1. The temperature sensors 7 and 9 are connected to the inputs of an electronic control unit 8. The control unit 8 optionally has further inputs for determining further operating conditions, such as inputs for determining the rpm of the internal combustion engine, the engine speed, the ambient temperature and/or the load on the internal combustion engine.

The mode of functioning of this cooling system, essential for the invention, is explained in connection with FIG. 2.

Figure 2:
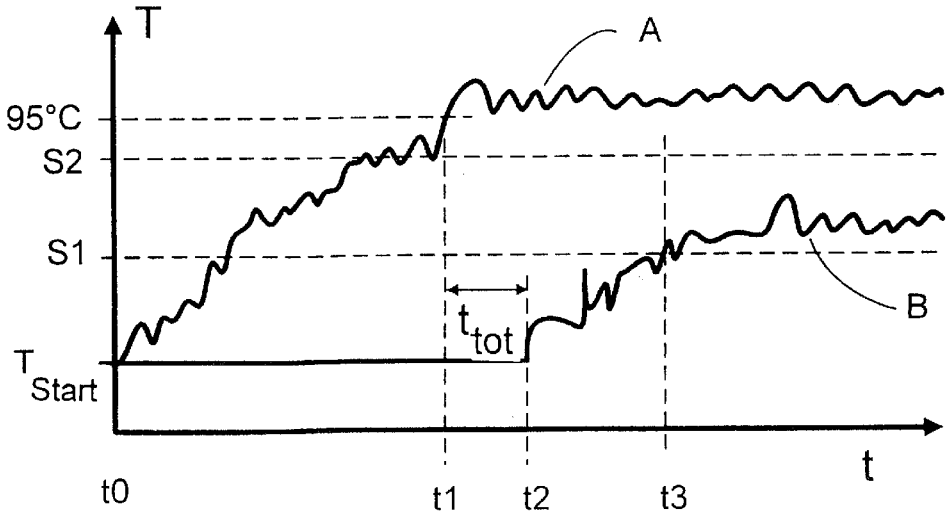
FIG. 2 shows typical temperature progressions when the thermostat valve is in working order.

In FIG. 2, the course A of the temperature of the coolant temperature at the outlet of the internal combustion engine 1 is shown. It is measured with temperature sensors 9, mounted, for example, in the cylinder head. The course B of the temperature refers to the coolant temperature at the outlet of the radiator 2, which is determined by way of the temperature sensor 7.

After a cold start of the internal combustion engine at time t0, for example, the temperature courses A and B commence at the same temperature $T_{start}$, which corresponds approximately to the ambient temperature. The temperature course A, determined with temperature sensor 9, rises relatively rapidly and, at time t1, reaches the opening temperature (such as 95° C.) of the thermostat valve 6. At least until time t1, the temperature course B remains constant because, with the thermostat valve in working order, heated coolant is not passed through the radiator 2 until the opening temperature is reached. At time t1, coolant commences to flow also through the thermostat valve 6, which is open at least partially, and through the radiator 2. At time t2, that is, after a short dead time $t_{tot}$, heated coolant reaches the outlet of the radiator and the temperature course B begins to rise.

If a specified increase in the temperature course B has not been recognized within a specified time t after time t1, which preferably is longer than time $t_{tot}$, it is concluded that the thermostat valve, which is not in the open state, has jammed defectively. If the temperature course B begins to rise already before time t1 is reached, it is concluded that the thermostat valve is leaking. In both cases, a preferably differentiated fault indication is entered by the control unit 8 in a fault diagnosis memory and/or is transmitted to an output unit.

At time t3, the temperature course B has reached a first threshold S1. This threshold S1 is selected so that a thermostat valve, which is in good working order, must be in the control operation when the coolant temperature at the outlet of the radiator 2 has reached at least this threshold S1. In the control operation, the coolant temperature at the outlet of the internal combustion engine 1 must be above a specified second threshold S2. In the normal case, the control temperature corresponds approximately to the opening temperature and, in the examples shown, is 95° C. The temperature course A, at time t3 and later, is at about 95° C. and, with that, above the threshold S2. Therefore, for the case shown, the thermostat valve is in good working order. If the coolant temperature at the outlet of the internal combustion engine, that is, the temperature course A, were to be below this second threshold S2 at time t3, an appropriate fault indication would be provided by the control unit 8 and/or an appropriate fault entry made in the fault memory, indicating too low a coolant temperature in the control operation.

A simple, reliable, differentiated, and rapidly concluded diagnosis function for monitoring the observance of a specific exhaust gas-reducing internal coolant water temperature of the internal combustion engine is attained by the invention. Since coolant temperature sensors at the outlet of the radiator and/or of the internal combustion engine are in many cases already present as standard equipment, additional structural changes to the cooling system may not be required.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

I claim:

1. A cooling system for an internal combustion engine comprising:

a pipeline leading from the internal combustion engine to a radiator, a return pipeline leading from the radiator to the internal combustion engine, a bypass line connecting the pipeline and the return pipeline, and a thermostat valve, through which coolant is passed from the internal combustion engine through at least one of the bypass line and the radiator back to the internal combustion engine, depending on the operating conditions, wherein at least one temperature sensor is provided to determine the temperature of the coolant at an outlet of the radiator, an output signal of the at least one temperature sensor being supplied to a control unit, wherein the at least one temperature sensor determines a start temperature of the coolant at the outlet of the radiator after a cold start of the internal combination engine and the temperature of the coolant at the outlet of the radiator during subsequent internal combustion engine operation, and wherein when a first operating condition, for which the coolant must be passed by way of the thermostat valve only through the bypass line, changes to a second operating condition, for which the coolant is permitted to flow by way of the thermostat valve at least partially through the radiator, the control unit checks whether an increase in the temperature of the coolant at the outlet of the radiator above the start temperature occurs and provides a fault indication when the temperature increase occurs abnormally.

2. The cooling system of claim 1, and further comprising a second temperature sensor, an output signal of which is also supplied to the control unit, which is provided to detect the temperature of the coolant at an outlet of the internal combustion engine.

3. The cooling system of claim 2, wherein the second operating condition is defined as attaining a specified coolant temperature at the outlet of the internal combustion engine, and wherein the control unit obtains this temperature by way of the second temperature sensor.

4. The cooling system of claim 2, wherein the control unit checks whether the temperature of the coolant at the outlet of the internal combustion engine is above a second threshold after the coolant temperature at the outlet of the radiator has reached or exceeded a first threshold.

5. The cooling system of claim 3, wherein the control unit checks whether the temperature of the coolant at the outlet of the internal combustion engine is above a second threshold after the coolant temperature at the outlet of the radiator has reached or exceeded a first threshold.

6. A process of operating a cooling system for an internal combustion engine with a pipeline leading from the internal combustion engine to a radiator, a return pipeline leading from the radiator to the internal combustion engine, a bypass line connecting the pipeline and the return pipeline, and a thermostat valve, through which coolant is passed from the internal combustion engine through at least one of the bypass line and the radiator back to the internal combustion engine, depending on operating conditions, comprising:

determining a start temperature of the coolant at the outlet of the radiator after a cold start of the internal combustion engine and the temperature of the coolant at the outlet of the radiator during subsequent internal combustion engine operation, supplying an output signal from a sensor determining the temperature to a control unit, checking whether an increase in the temperature of the coolant above the start temperature occurs at the outlet of the radiator when a first operating condition, in which the coolant must be passed by way of the thermostat valve only through the bypass line, changes to a second operating condition, in which the coolant is permitted to flow by way of the thermostat valve at least partially through the radiator, and providing a fault indication when the temperature increase occurs abnormally.

7. The process of claim 6, and further comprising supplying an output signal from a second sensor, which detects the temperature of the coolant at an outlet of the internal combustion engine, to the control unit.

8. The process of claim 7, wherein the second operating condition is defined as attaining a specified coolant temperature at the outlet of the internal combustion engine, and wherein the control unit obtains this temperature by way of the second temperature sensor.

9. The process of claim 7, wherein the control unit checks whether the temperature of the coolant at the outlet of the internal combustion engine is above a second threshold after the coolant temperature at the outlet of the radiator has reached or exceeded a first threshold.

10. The process of claim 7, wherein the control unit checks whether the temperature of the coolant at the outlet of the internal combustion engine is above a second threshold after the coolant temperature at the outlet of the radiator has reached or exceeded a first threshold.

* * * * *